US005509222A

United States Patent [19]

Rathenberg

[11] Patent Number: 5,509,222

[45] Date of Patent: Apr. 23, 1996

[54] RECEIVING CONTAINER FOR CARD-LIKE INFORMATION CARRIERS

[76] Inventor: Jürgen Rathenberg, Northeimer Strasse 4, D-37581 Bad Gandersheim, Germany

[21] Appl. No.: 221,060

[22] Filed: Mar. 30, 1994

[30] Foreign Application Priority Data

Apr. 28, 1993 [DE] Germany ..... 9306413 U

[51] Int. Cl.[6] ..... A44C 3/00

[52] U.S. Cl. ..... 40/1.5; 40/586; 40/1.6; 206/39

[58] Field of Search ..... 40/1.5, 1.6, 663, 40/586; 206/37, 38, 39, 39.1–39.5, 39.6, 449; 24/3.1, 3.11, 3.12, 663, 669

[56] References Cited

U.S. PATENT DOCUMENTS

| | | | |
|---|---|---|---|
| 2,279,259 | 4/1942 | Ballou, Jr. | 40/1.5 X |
| 3,344,543 | 6/1965 | Griffin et al. | 40/1.5 |
| 4,272,869 | 6/1981 | Willner | 24/3.12 |
| 4,419,794 | 12/1983 | Horton, Jr. et al. | 24/669 X |
| 4,518,080 | 5/1985 | Ohlson | 206/39 |

*Primary Examiner*—Peter M. Cuomo
*Assistant Examiner*—James O. Hansen
*Attorney, Agent, or Firm*—Michael J. Striker

[57] ABSTRACT

A receiving container for card-like information carriers comprises a container part having a rear surface provided with a plug button and a plurality of friction projections surrounding the plug button, and a plug part having a receiving opening which is releasably engageably pluggable on the plug button and having a plurality of engaging projections, the plug part being frictionally and form-lockingly releasably and turnably pluggable on the plug button, the plug part being provided with a clamping member for mounting on a clothing piece.

5 Claims, 3 Drawing Sheets

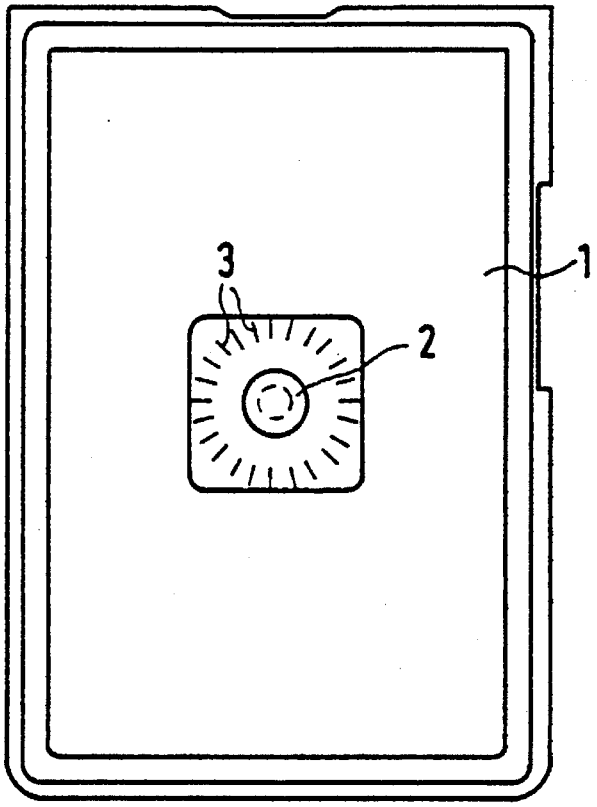
Fig. 1
Fig. 3
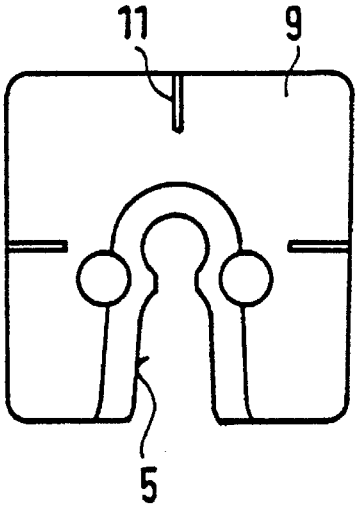
Fig. 3a
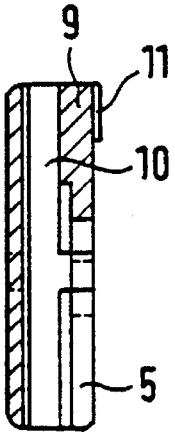

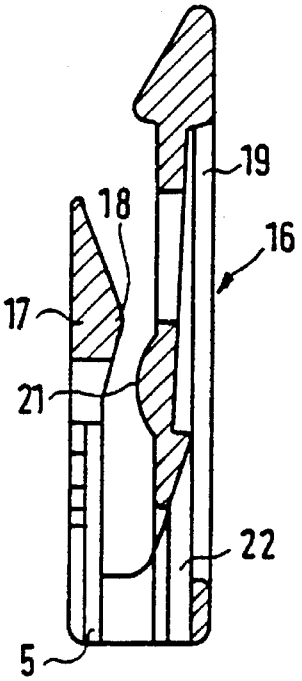
Fig. 5a
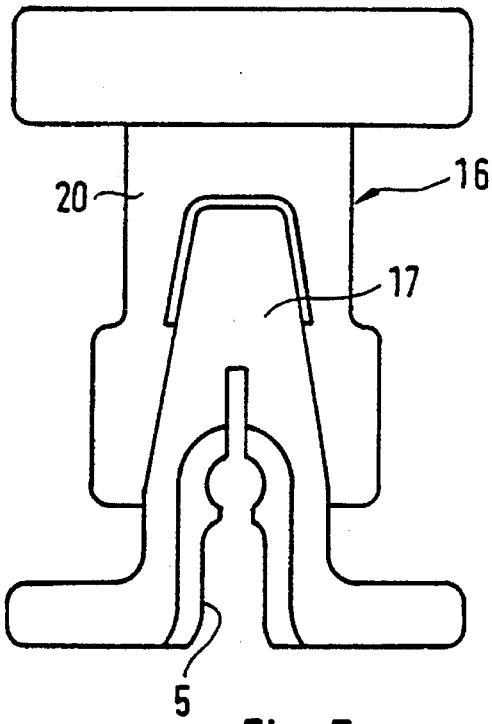
Fig. 5
Fig. 6a
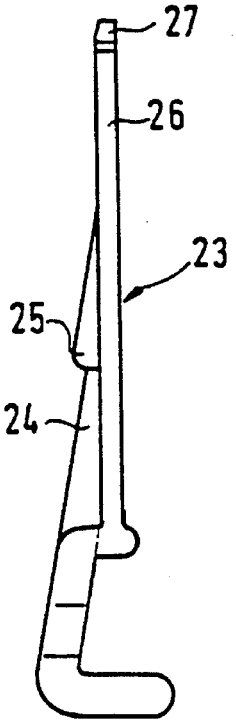
Fig. 6
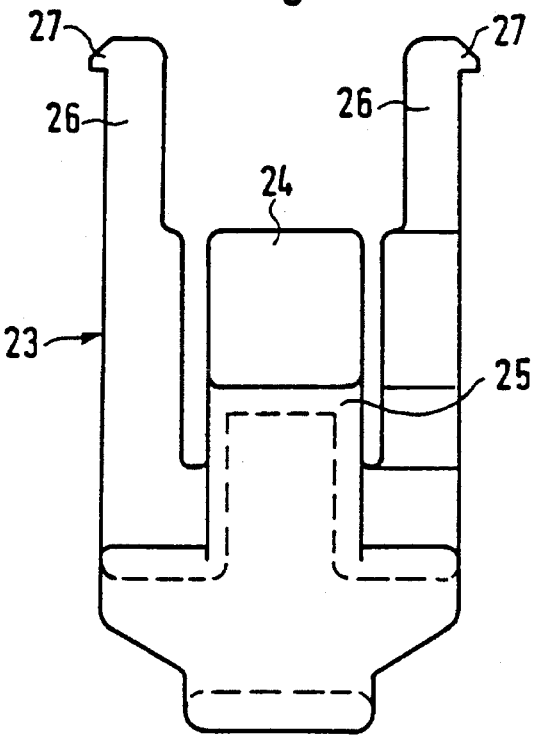

RECEIVING CONTAINER FOR CARD-LIKE INFORMATION CARRIERS

BACKGROUND OF THE INVENTION

The present invention relates to a receiving container composed of synthetic plastic material and provided with card-like information carriers with a clamping device for mounting on clothing.

Such receiving containers are used for receiving name tags, identification cards, and the like required during conferences or for entering security areas or the like. The receiving containers of this type are worn on clothing. In the case of identification cards and the like, it is frequently required to remove information carriers from such a receiving container, to use it and then to introduce back into the receiving container. For mounting the receiving containers on the clothing it is known to provide a conventional clamping device with bands or the like in slots or other passages in the receiving container so that the receiving container can be loosely suspended on the clamping device. This solution however has the disadvantage that the receiving container is loosely suspended on the clothing, and in particular when it is used with name tag it does not occupy a position provided for the text or in other words it is difficult to read and must be constantly oriented properly. In the case of security cards it is necessary to release the whole receiving container with the clamping device on the clothing for withdrawing the card or in the safety areas or the like mounting the receiving container on alternating clothing.

SUMMARY OF THE INVENTION

Accordingly, it is an object of the present invention to provide a receiving container of the above mentioned type, which avoids the disadvantages of the prior art.

In keeping with these objects and with others which will become apparent hereinafter, one feature of the present invention resides, briefly stated, in a receiving container which has a rear surface provided with a plug button and a friction projection surrounding the plug button and a plug part provided with a slot-shaped plug opening having engaging projections releasably engageable with a shaft of a plug button and also having a clamping device for mounting on a clothing, so that the plug part is frictionally and form-lockingly plugged on the plug button.

When the receiving container is designed in accordance with the present invention, it eliminates the disadvantages of the prior art, and substantially improves and simplifies handling and use of the container.

The plug part which is pluggable on the plug projection provides the desired position of the plug part and thereby the clamping device relative to the receiving container in the frictional and form-locking manner and the plug part with the clamping device is easily released by pulling the plug button from the receiving container and therefore the receiving container can be freely manipulated for withdrawal of the information carrier for its use and latter insertion into the container and then by simple plugging of the plug part on the plug button can be again mounted on the clothing without releasing the clamping device from the clothing. By fixing the position of the receiving container on the plug part and thereby the clamping device, the receiving container can be mounted on any edge of a clothing and maintains the desired position, for example for mounting on a band, a pocket or the like.

The manufacture of the plug button on the receiving container with its friction projections is exceptionally simple with the use of conventional shaping processes for synthetic plastic parts, and the plug button has a simple design and is simple to produce. In the case of receiving containers for security cards and the like, there is the further advantage that during an exchange of the clothing inside the respective spaces or the like, either the clamping device with the plug part can remain on the respective clothing piece or it is possible to provide several plug parts with the clamping device for using with several clothing pieces and the respective receiving container can be connected with a clamping device by a simple plugging.

In accordance with another advantageous feature of the present invention, the plug part is elongated and provided with the plug opening at one free end with a holding opening at another free end for mounting a clamping device. In this construction the plug part has a suitable, for example slot-shaped opening at the free end in which the known clamping devices can be mounted in a known manner.

In accordance with another advantageous feature of the present invention, the plug part has a throughgoing plug slot in which a springy, arrestingly and releasably fixable tongue of an elongated holding part is insertable, whose free opposite end is formed for mounting a clamping device. In this alternative embodiment it is possible to leave the plug part which is plugged frictionally and form-lockingly in the desired position on the receiving container, and at the same time to remove the holding part which carries the clamping device from the slot of the plug part with a springy release of the tongue from the plug part, with the above described advantages.

In accordance with a further embodiment of the present invention, the plug part has a U-shaped cross-section with one leg forming the plug opening for the plug button and the free end forming an arresting element, while the other leg has a central clamping tongue facing the base and formed with two plug slots pluggable in a longitudinal clamping part. In this construction the whole arrangement which contains the plug part on the plug container forms a clamping device and thereby the separate clamping device can be dispensed with.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a view showing a rear side of a receiving container with a plug button and friction projections in accordance with the present invention;

FIGS. 3 and 3*a* are a rear view and a sectional view of a plug part in accordance with a second embodiment of the invention;

FIGS. 5 and 5*a* are a plan view and a section view of a plug part; and

FIGS. 6 and 6*a* are a plan view and a side view of a clamping part for use with the plug part of FIGS. 5 and 5*a* in accordance with a further embodiment of the invention.

DESCRIPTION OF THE PREFERRED EMBODIMENTS

Figure 2:
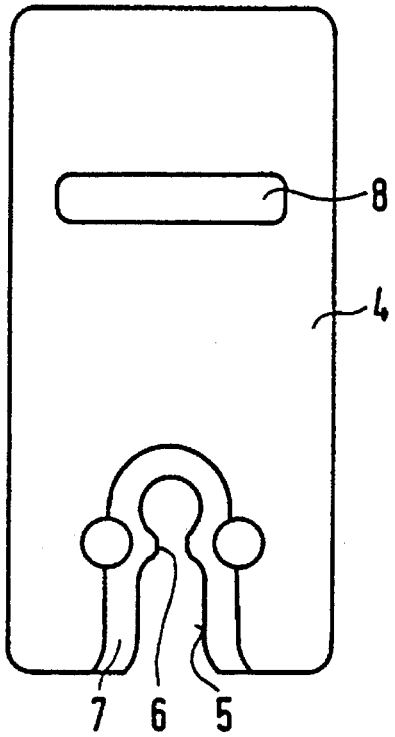
FIG. 2 is a plan view of a plug part which is formed as a holding part for a clamping device in accordance with the first embodiment of the present invention.

FIG. 1 shows a rear surface of a receiving container 1 composed of synthetic plastic material and having a conventional shape. In the receiving container 1 shown in FIG. 1 a plug button 2 is arranged on the rear surface and is surrounded by friction projections 3 having a small height and schematically identified by lines in the drawing.

FIG. 2 shows an elongated plug part 4 composed of synthetic plastic material and having a rectangular shape. It is provided with a plug opening 5 at its one end. The plug opening preferably has rounded projections 6 extending inwardly. The plug part 4 is pluggable on the plug button 2 by means of the plug opening 5 with the projections 6. For this purpose either the thickness of the plug part 4 can be correspondingly selected or in the region of the plug opening 5 a reduction can be provided for receiving the head of the plug button as schematically identified with reference numeral 7. The plug part 4 at its free end is provided with a holding opening 8 formed here as a slot for receiving a conventional clamping device. For increasing the frictional and form-locking connection of the plug part 4 with the receiving container 1, the rear side of the plug part 4 can be provided with similar friction projections as the friction projections 3.

FIG. 3 shows a plug part 9 for another embodiment of the invention. The plug part 9 has a plug opening 5 similar to the plug opening of FIG. 2. The plug part 9 is approximately square and has a throughgoing plug slot 10 extending in a longitudinal direction and preferably in direction of the plug opening 5. The plug part 9 is also provided with arresting projections 11 which frictionally and form-lockingly cooperate with the arresting projections 3 of the receiving container 1.

Figure 4:
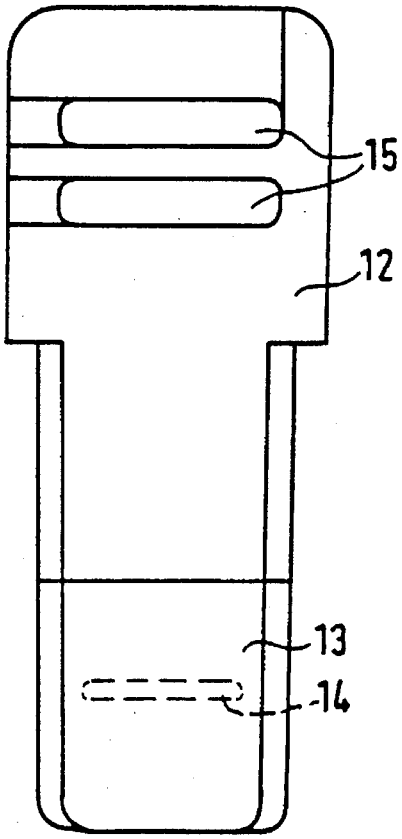
FIG. 4 and 4*a* are a plan view and a side view of a holding part for use with the plug part of FIGS. 3 and 3*a;*
Figure 4A:
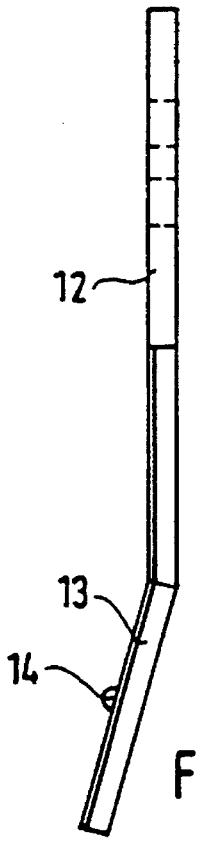

In this embodiment a longitudinally extending holding part 12 is provided. It is composed of synthetic plastic material and has a springy tongue 13 which is arrestingly and releasably fixed and has an arresting projection 14. The holding part 12 is pluggable with its tongue 13 into the slot 10 of the plug part 9 and is fixed in the plug condition arrestingly and releasably in the plug part 9. For this purpose the tongue 13, as shown in FIG. 4*a* can be slightly angled. The holding part at its free end carries one or several slots 15 for mounting a conventional clamping device.

FIGS. 5, 5*a*, 6 and 6*a* show a further embodiment of the invention which forms the clamping device itself. A plug part 16 shown in FIGS. 5 and 5*a* is elongated and has a U-shape as shown in FIG. 5*a*. One leg 17 of the plug part 16 at its base side has a plug opening 5 corresponding to the previous embodiment, while the free end has an inner arresting projection 18. The other leg 19 which is longer than the leg 17 carries at its base a central clamping tongue 20 with a rounded inner projection 21. Both inner longitudinal sides, as in the body shown in FIG. 5, are provided with plug slots 22.

FIG. 6 and 6a show an elongated clamping part 23 which is pluggable in the plug part 16. The elongated clamping part 23 has a central springy tongue 24 with an arresting member 25 which is releasably springy arrestable with the arresting member 18 of the leg 17 of the plug part 16, and also two outer springy side webs 26. The springy side webs 26 are pluggable into the plug slot 22 of the other leg 19 of the plug part 16 releasably and with an abutment, so that between the leg 17 of the plug part 16 and the central tongue 24 of the clamping part 23 a closing piece can be clamped. The springy side webs 26 on their free ends are provided respectively with arresting projections 27 which in the inserted condition releasably engage in or on the plug slot 22, which is not shown in the drawings but can be formed in a known manner.

The plug part 16 and the clamping part 23 together form the clamping holder for mounting of the receiving container 1 on the clothing or the like. The clamping part 23 can be easily released from the plug part 16 when needed by slightly compressing the springy side webs and slightly deviating the tongue 24.

All above described parts of the receiving container in accordance with the present invention can be composed of elastic synthetic plastic material.

It will be understood that each of the elements described above, or two or more together, may also find a useful application in other types of constructions differing from the types described above.

While the invention has been illustrated and described as embodied in a receiving container for card-like information carriers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A receiving container for card-like information carriers, comprising a container part having a rear surface provided with a plug button and a plurality of friction projections surrounding said plug button; and a plug part having a receiving opening provided with inwardly extending projections which are releasably engageably pluggable on said plug button and is provided with a plurality of engaging projections engageable with said friction projections of said container part, said plug part being frictionally and form-lockingly releasably and turnably pluggable on said plug button, said plug part being provided with clamping means for mounting on a clothing piece.

2. A receiving container as defined in claim 1, wherein said receiving opening of said plug part is slot-shaped.

3. A receiving container as defined in claim 1, wherein said plug part is composed of synthetic plastic material.

4. A receiving container as defined in claim 1, wherein said plug part is elongated and has one end provided with said receiving opening and another end provided with a holding opening for mounting said clamping device.

5. A receiving container as defined in claim 1, wherein said plug part has a throughgoing plug slot; and further comprising an elongated holding part having a springy and arrestingly and releasably fixing tongue pluggable in said throughgoing plug slot of said plug part, said holding part having a free end for mounting said clamping device.

* * * * *